US008505876B2

(12) United States Patent
Lindskog

(10) Patent No.: US 8,505,876 B2
(45) Date of Patent: Aug. 13, 2013

(54) FORCIBLE ENTRY TOOL

(75) Inventor: Peter Lindskog, Göteborg (SE)

(73) Assignee: Gränsfors Smide i Gnarp AB, Gnarp (SE)

( * ) Notice: Subject to any disclaimer, the term of this patent is extended or adjusted under 35 U.S.C. 154(b) by 421 days.

(21) Appl. No.: 12/863,530

(22) PCT Filed: Jan. 18, 2008

(86) PCT No.: PCT/EP2008/050557

§ 371 (c)(1),
(2), (4) Date: Oct. 4, 2010

(87) PCT Pub. No.: WO2009/089915

PCT Pub. Date: Jul. 23, 2009

(65) Prior Publication Data

US 2011/0062400 A1 Mar. 17, 2011

(51) Int. Cl.
*B25C 11/00* (2006.01)

(52) U.S. Cl.
USPC ..... 254/25; 254/104

(58) Field of Classification Search
USPC ..... 254/104, 21, 25, 19
See application file for complete search history.

(56) References Cited

U.S. PATENT DOCUMENTS

| | | | | |
|---|---|---|---|---|
| 1,613,729 | A | 1/1927 | Shearwood | |
| 1,647,576 | A * | 11/1927 | Nowka et al. | 7/158 |
| 3,705,430 | A | 12/1972 | Ziaylek | |
| 5,695,172 | A | 12/1997 | Hreha | |
| 5,732,932 | A * | 3/1998 | Michalo | 254/93 R |
| 6,916,013 | B2 * | 7/2005 | Cardona | 254/93 R |
| 7,634,830 | B2 * | 12/2009 | Ryan | 7/166 |
| 2004/0261188 | A1 * | 12/2004 | Mathis | 7/145 |
| 2007/0283503 | A1 * | 12/2007 | Ryan | 7/166 |
| 2009/0114891 | A1 * | 5/2009 | Metz | 254/25 |
| 2011/0113566 | A1 * | 5/2011 | Holbrook | 7/146 |

FOREIGN PATENT DOCUMENTS

| | | |
|---|---|---|
| EP | 1057594 | 12/2000 |

* cited by examiner

*Primary Examiner* — Lee D Wilson
(74) *Attorney, Agent, or Firm* — Dilworth & Barrese, LLP.

(57) ABSTRACT

The invention relates to a tool (1) for forcing a door comprising: —an elongated shaft (2) having a front end and a rear end; —a handgrip (10) located between the front end and the rear end of the shaft; and—a head (5) fixed to the shaft at the front end thereof, the head having a base part (6) provided with a striking surface (7) on a first side for receiving impacts from a striking tool and a wedge part (8) extending from the base part on the opposite side thereof essentially perpendicularly to the longitudinal axis of the shaft.

18 Claims, 3 Drawing Sheets

FORCIBLE ENTRY TOOL

FIELD OF THE INVENTION AND PRIOR ART

The present invention relates to a tool according to the description herein designed to be usable for forcing a door.

The tool according to the invention is particularly intended to be used for forcing doors that swing outwardly.

Various tools to be used to gain forcible entry through locked doors are known. Such tools are intended to be used for instance by police, military, firemen or rescue crews in order to gain access through a closed door into a building, room, vehicle or other closed space, for instance in an emergency situation.

A tool is previously known from U.S. Pat. No. 3,705,430.

SUMMARY OF THE INVENTION

The object of the present invention is to provide a door forcing tool of new and advantageous design.

According to a first aspect of the present invention, said object is achieved by a tool having the features defined herein. This tool comprises:

- an elongated shaft having a front end and a rear end;
- a first handgrip located between the front end and the rear end of the shaft;
- a second handgrip located between the first handgrip and the rear end of the shaft; and
- a head fixed to the shaft at the front end thereof, the head having a base part provided with a striking surface on a first side for receiving impacts from a striking tool and a wedge part extending from the base part on the opposite side thereof essentially perpendicularly to the longitudinal axis of the shaft.

The shaft is provided with a support member located between the first handgrip and the second handgrip. The support member protrudes from the shaft on the same side as the wedge part so as to allow the support member to abut against a door surface and thereby support the shaft against the door surface when the tip of the wedge part, by a person holding the tool with the hands grasping said handgrips, is pressed into a slot formed between a door and its doorframe.

When the tool is applied in the intended manner against a door, a moment arm for the striking force exerted by a striking tool hitting the striking surface on the head will be formed between the striking surface and the fulcrum of the support member, i.e. the point where the support member abuts against the door surface. This moment arm will secure that the striking force will cause a torque tending to drive the tip of the wedge part of the head deeper into the slot between the door and the doorframe so as to thereby spread the door and the jamb of the doorframe apart. Without such a support member on the shaft, the fulcrum of the tool against a door to be forced might be located on the wedge part and the striking force would then cause a torque tending to drive the tip of the wedge part out of the slot between the door and the doorframe.

Further advantages as well as advantageous features of the tool according to the first aspect of the invention will appear from the following description.

According to a second aspect of the present invention, said object is achieved by a tool having the features defined herein. This tool comprises:

- an elongated shaft having a front end and a rear end;
- a handgrip located between the front end and the rear end of the shaft; and
- a head fixed to the shaft at the front end thereof, the head having a base part provided with a striking surface on a first side for receiving impacts from a striking tool and a wedge part extending from the base part on the opposite side thereof essentially perpendicularly to the longitudinal axis of the shaft.

Said handgrip is located at a distance from and parallel to the shaft, and a guiding surface is provided between the striking surface on the head and the front end of said handgrip, the guiding surface being inclined from the front end of the handgrip towards the striking surface so as to direct a hitting striking tool away from the handgrip and thereby prevent the hand of a person grasping the handgrip from being hit by the striking tool.

Further advantages as well as advantageous features of the tool according to the second aspect of the invention will appear from the following description.

BRIEF DESCRIPTION OF THE DRAWINGS

With reference to the appended drawings, a specific description of preferred embodiments of the invention cited as examples follows below. In the drawings.

DETAILED DESCRIPTION OF EMBODIMENTS OF THE INVENTION

Figure 1:
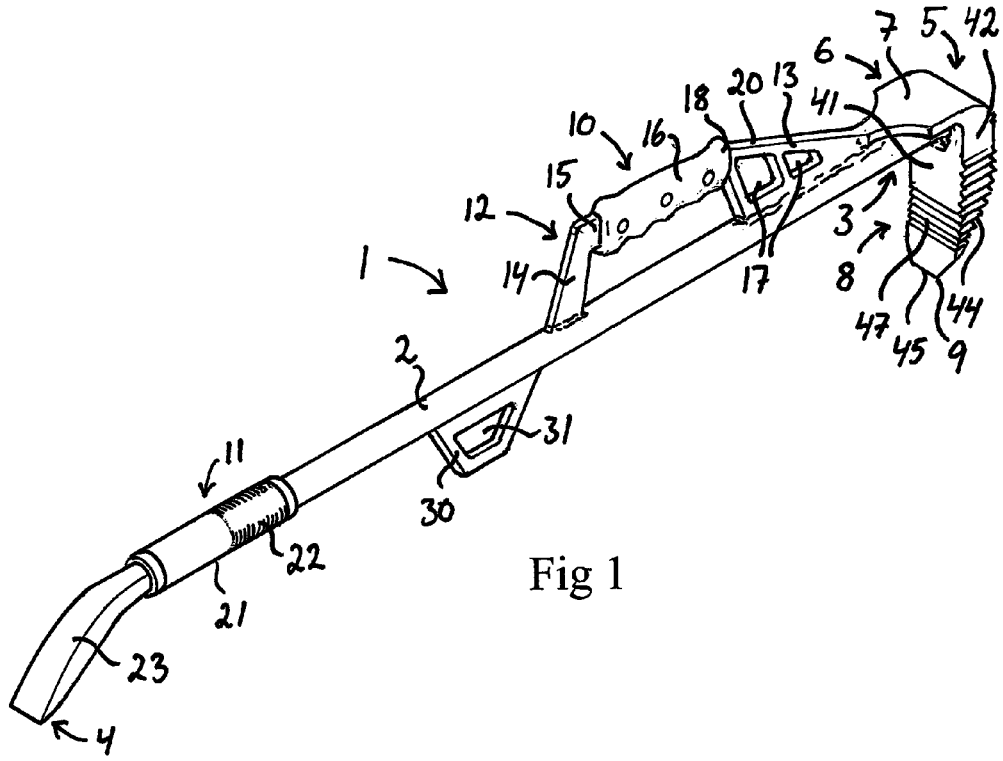
FIG. 1 is a perspective view from above of a tool according to a first embodiment of the present invention.

Two different embodiments of a tool according to the present invention are illustrated in FIGS. 1-4. The respective tool 1 comprises a rigid elongated shaft 2 having a front end 3 and a rear end 4. A head 5 is fixed to the shaft 2 at the front end 3 thereof. The head 5 has a base part 6 provided with a striking surface 7 on a first side for receiving impacts from a striking tool and a wedge part 8 extending from the base part 6 on the opposite side thereof essentially perpendicularly to the longitudinal axis of the shaft 2.

A first handgrip 10 is located between the front end 3 and the rear end 4 of the shaft 2, and a second handgrip 11 is located between the first handgrip 10 and the rear end 4 of the shaft 2.

In the illustrated embodiments, the first handgrip 10 is located at a distance from and parallel to the shaft 2. The first handgrip 10 is supported at a distance from the shaft 2 by means of a support 12 which is fixed to the shaft 2. The first handgrip 10 and the wedge part 8 are arranged on opposite sides of the shaft 2. The support 12 comprises a first part 13, a second part 14 and an intermediate part 15 extending between the first part 13 and the second part 14. The first handgrip 10 is provided on the intermediate part 15 and may be formed by the intermediate part itself or by a handgrip member 16 fitted about the intermediate part 15. One end of the intermediate part 15 is connected to the shaft 2 by means of said first part 13 of the support and the other end of the intermediate part 15 is connected to the shaft 2 by means of said second part 14 of the support. One or several holes 17 may be provided in said first part 13 of the support 12 in order to save material and reduce the weight of the tool 1, as illustrated in FIGS. 1-4. The support 12 may of course also have other designs than here shown.

A guiding surface 20 is provided between the striking surface 7 on the head 5 and the front end 18 of the first handgrip 10. The guiding surface 20 is inclined from the front end 18 of the first handgrip 10 towards the striking surface 7 so as to guide a hitting striking tool away from the first handgrip 10 and thereby prevent the hand of a person grasping the first handgrip from being hit by the striking tool. In the illustrated examples, the guiding surface 20 is formed by the forwardly facing outer edge of the above-mentioned first part 13 of the support 12.

In the illustrated embodiments, the second handgrip 11 is coaxial with the shaft 2. The second handgrip 11 may be formed by a part of the shaft 2 or by a handgrip member 21 fitted about the shaft 2. The first handgrip 10 and/or the second handgrip 11 may be provided with a resilient shock absorbing material layer 22 in order to make it more comfortable for a person to hold the tool 1 with the hands grasping the handgrips 10, 11 when another person hits against the striking surface 7 on the head 5 by means of a striking tool. In the illustrated examples, the forward part of the second handgrip 11 is provided with such a shock absorbing material layer 22.

The shaft 2 is provided with a support member 30 located between the first handgrip 10 and the second handgrip 11. The support member 30 protrudes from the shaft 2 on the same side of the shaft as the wedge part 8 so as to allow the support member 30 to abut against a door surface and thereby support the shaft 2 against the door surface when the tip 9 of the wedge part 8, by a person holding the tool 1 with the hands grasping the handgrips 10, 11, is pressed into a slot formed between a door and its doorframe (see FIG. 5). Thus, the support member 30 forms a fulcrum for the tool 1 when the tool is applied against the outside of a door.

In the illustrated embodiments, the support member 30 has the form of a plate, which is fixed to the shaft 2 and shaped as a truncated triangle with the base of the truncated triangle facing the shaft 2. One or several holes 31 may be provided in the support member 30 in order to save material and reduce the weight of the tool 1, as illustrated in FIGS. 1-4. The support member 30 may of course also have other designs than here shown.

In the illustrated embodiments, the rear portion 23 of the shaft 2 is bent inwards so as to form a rear support for the shaft on the same side of the shaft as the support member 30. Hereby, the rear end 4 of the shaft is allowed to support the tool 1 against a door surface together with the support member 30 and thereby secure that the second handgrip 11 is kept at a distance from the door surface so as to thereby prevent a hand grasping the second handgrip 11 from hitting the door surface and being injured.

Figure 2:
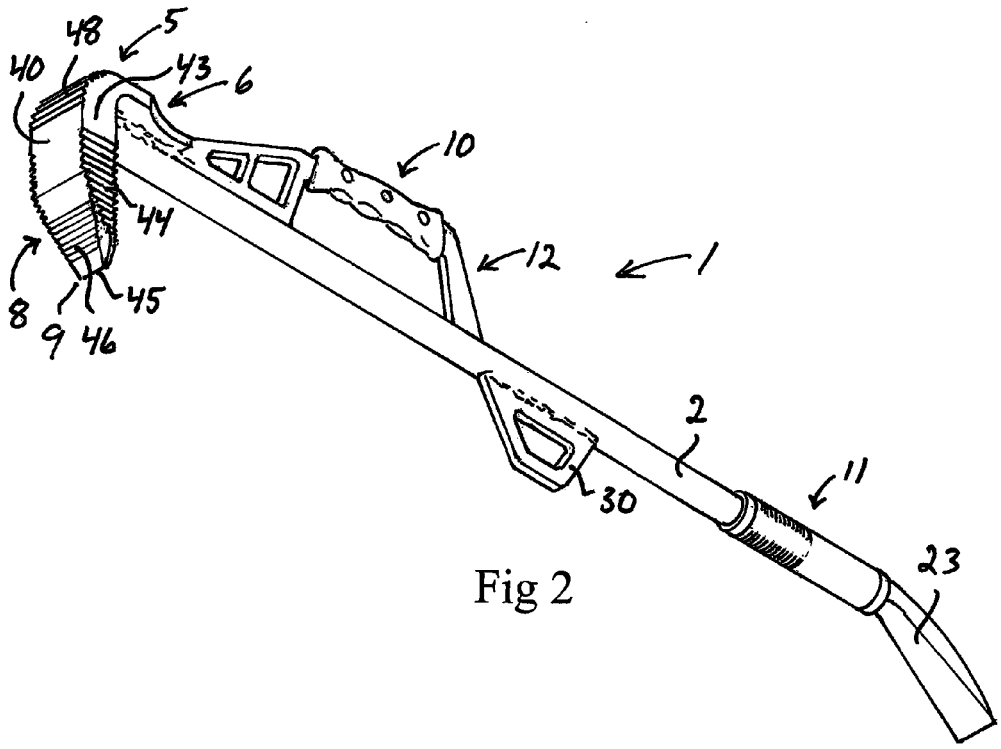
FIG. 2 is a perspective view from below of the tool shown in FIG. 1.

In the embodiment illustrated in FIGS. 1 and 2, the wedge part 8 comprises a top surface 40, a bottom surface 41 and two side walls 42, 43 extending between the top surface 40 and the bottom surface 41 on opposite sides of the wedge part. Each one of said side walls 42, 43 is provided with cutting edges 44 extending in parallel to each other or at least essentially in parallel to each other between the bottom surface 41 and the top surface 40. The cutting edges 44 are integrated in the wedge part 8 and are formed by suitable machining of the wedge part. The cutting edges 44 on a side wall 42, 43 are mutually separated by grooves formed in the side wall. At the tip 9 of the wedge part 8, the top surface 40 is inclined towards the bottom surface 41 so as to form a sharp edge 45 extending in the cross-direction of the shaft 2. Near the tip 9, the top surface 40 and the bottom surface 41 are suitably provided with a grooved zone 46, 47 in order to prevent slippage of the wedge part 8 with respect to a door edge or a jamb of a doorframe. A convexly curved surface 48 connects the top surface 40 of the wedge part 8 to the striking surface 7 of the base part 6. This curved surface 48 is with advantage grooved, at least partially, in order to prevent slippage of the head 5 with respect to a jamb of a doorframe.

Figure 3:
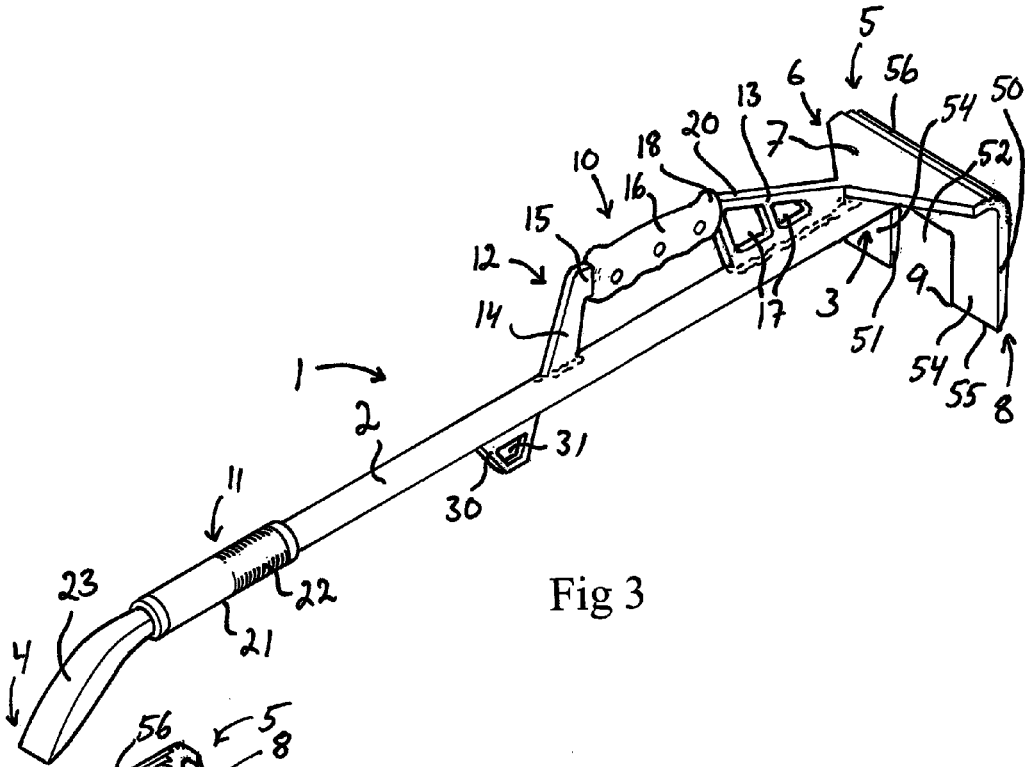
FIG. 3 is a perspective view from above of a tool according to a second embodiment of the present invention.
Figure 4:
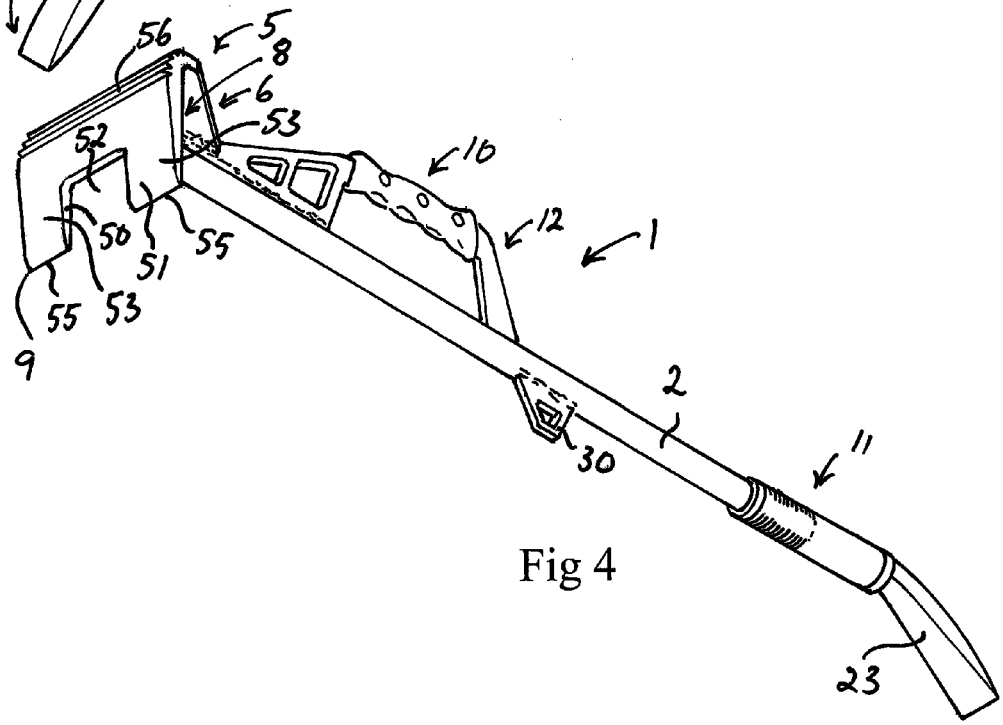
FIG. 4 is a perspective view from below of the tool shown in FIG. 3, and FIG. 5 schematically illustrates the use of a tool according to the invention for forcing a locked door, with a part of the door and tool shown in a detail enlargement.

In the embodiment illustrated in FIGS. 3 and 4, the wedge part 8 comprises two wedge members 50, 51 which are separated by an intermediate gap 52. At the tip 9 of the wedge part 8, the top surface 53 of the respective wedge member 50, 51 is inclined towards the bottom surface 54 of the wedge member so as to form a sharp edge 55 extending in the cross-direction of the shaft 2. A convexly curved surface 56 connects the top surface 53 of the respective wedge member 50, 51 to the striking surface 7 of the base part 6. This curved surface 56 is with advantage grooved, at least partially, in order to prevent slippage of the head 5 with respect to a doorframe.

The shaft 2, the head 5, the support 12 and the support member 30 are to be made of strong metallic material, such as for instance steel. The head 5, the support 12 and the support member 30 may be formed as separate parts and fixed to the shaft 2 by welding.

The tool 1 according to the embodiment illustrated in FIGS. 1 and 2 is mainly intended to be used for forcing a door of steel or other metallic material that swing outwardly. The tool 1 according to the embodiment illustrated in FIGS. 3 and 4 is mainly intended to be used for forcing a door of wood that swing outwardly. The edges 55 of the wedge members 50, 51 of the latter tool 1 are intended to be forced into the slot between a door and its doorframe on opposite sides of a locking bolt of the door.

Figure 5:
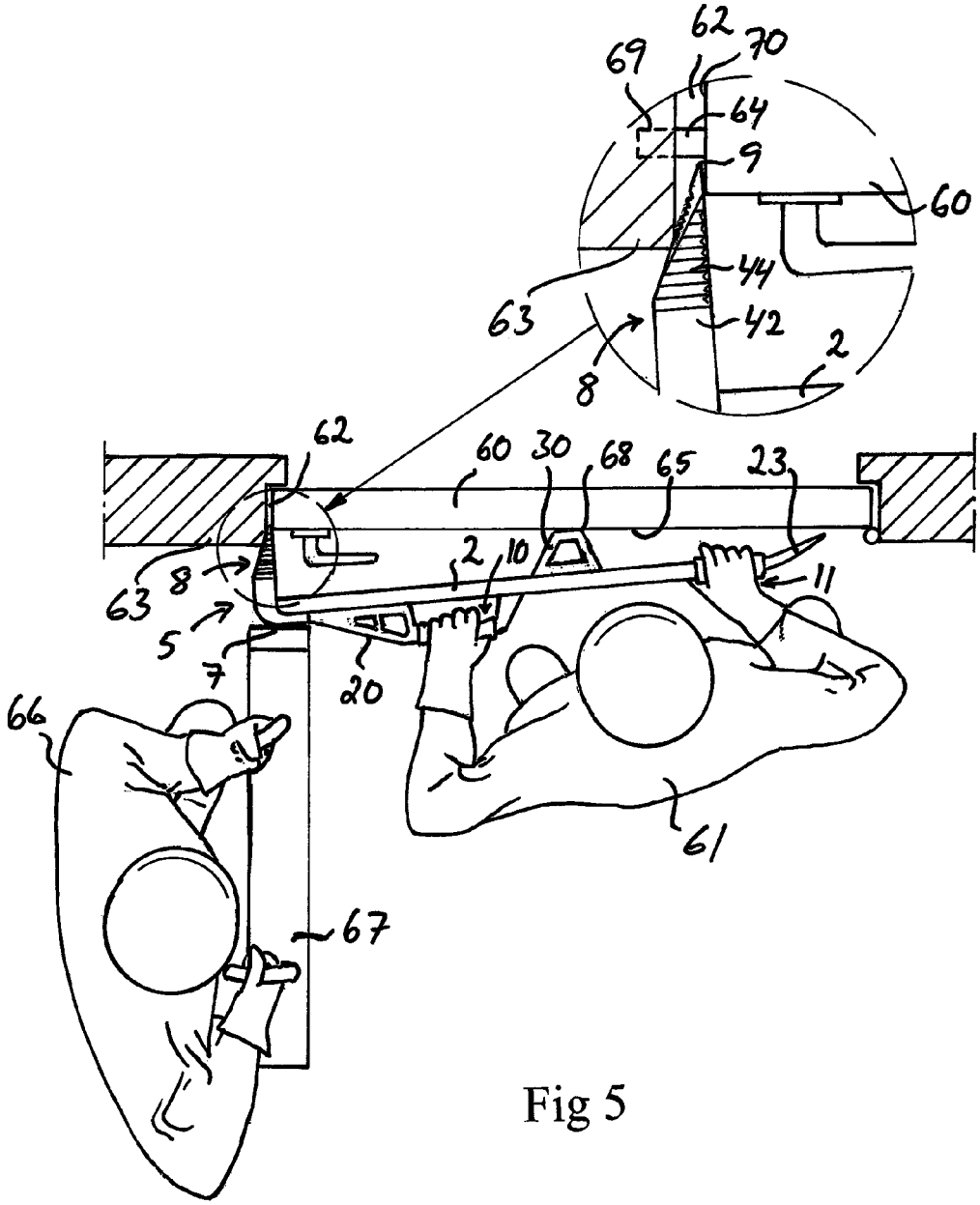

FIG. 5 illustrates the use of the tool 1 according to FIGS. 1 and 2 for forcing a door 60. A person 61 holds the tool with one hand grasping the first handgrip 10 and the other hand grasping the second handgrip 11. The person 61 presses the tool 1 against the door in such a manner that the tip 9 of the wedge part 8 is inserted into the slot 62 formed between the door 60 and the jamb 63 of the doorframe adjacent to the locking bolt 64 of the door lock, whereas the support member 30 is pressed against the outer surface 65 of the door so as to form a fulcrum 68 for the tool 1. Another person 66 will then hit against the striking surface 7 by means of a suitable striking tool 67, for instance in the form of a ram, so as to force the wedge part 8 deeper into the slot 62 between the door 60 and the jamb 63 and thereby spread the door 60 and the jamb 63 apart in order to make the slot 62 larger. When the wedge part 8 has been forced a suitable distance into the slot 62, the person 61 holding the tool 1 may pivot the shaft 2 upwards and downwards so as to make the wedge part 8 turn about its longitudinal axis inside the slot 62 in order to make the slot 62 so large that the locking bolt 64 is allowed to leave its bolt hole 69 in the jamb 63. When the wedge part 8 is turned inside the slot 62, the cutting edges 44 on the side walls 42, 43 of the wedge part 8 will cut into the jamb 63 and the edge 70 of the door 60 and give the wedge part 8 a good grip with respect to the jamb 63 and the door edge 70, thereby preventing the wedge part 8 from sliding out of the slot. Finally, the person 61 holding the tool 1 will pivot the shaft 2 outwards away from the outer surface 65 of the door so as to make the door 60 spring open.

The invention is of course not in any way restricted to the embodiments described above. On the contrary, many possibilities to modifications thereof will be apparent to a person with ordinary skill in the art without departing from the basic idea of the invention such as defined in the appended claims.

The invention claimed is:

1. A tool for forcing a door, wherein the tool (1) comprises:

an elongated shaft (2) having a front end (3) and a rear end (4);

a first handgrip (10) located between the front end (3) and the rear end (4) of the shaft (2); and a head (5) fixed to the shaft (2) at the front end (3) thereof, the head (5) having a base part (6) provided with a striking surface (7) on a first side for receiving impacts from a striking tool and a wedge part (8) extending from the base part (6) on the opposite side thereof essentially perpendicularly to the longitudinal axis of the shaft (2), the tool (1) comprises a second handgrip (11) located between the first handgrip (10) and the rear end (4) of the shaft (2); and the shaft (2) is provided with a support member (30) located between the first handgrip (10) and the second handgrip (11), the support member (30) protruding from the shaft (2) on the same side of the shaft as the wedge part (8) so as to allow the support member (30) to abut against a door surface and thereby support the shaft (2) against the door surface when the tip (9) of the wedge part (8), by a person holding the tool (1) with the hands grasping said handgrips (10, 11), is pressed into a slot formed between a door and its doorframe.

2. A tool according to claim 1, wherein the support member (30) has the form of a plate, which is fixed to the shaft (2).

3. A tool according to claim 2, wherein the support member (30) is shaped as a truncated triangle with the base of the truncated triangle facing the shaft (2).

4. A tool according to claim 3, wherein the first handgrip (10) is located at a distance from and parallel to the shaft (2).

5. A tool according to claim 4, wherein a guiding surface (20) is provided between the striking surface (7) on the head (5) and the front end (18) of the first handgrip (10), the guiding surface (20) being inclined from the front end (18) of the first handgrip (10) towards the striking surface (7) so as to guide a hitting striking tool away from the first handgrip (10) and thereby prevent the hand of a person grasping the first handgrip from being hit by the striking tool.

6. A tool according to claim 5, wherein the second handgrip (11) is coaxial with the shaft (2).

7. A tool according to claim 2, wherein the first handgrip (10) is located at a distance from and parallel to the shaft (2).

8. A tool according to claim 7, wherein a guiding surface (20) is provided between the striking surface (7) on the head (5) and the front end (18) of the first handgrip (10), the guiding surface (20) being inclined from the front end (18) of the first handgrip (10) towards the striking surface (7) so as to guide a hitting striking tool away from the first handgrip (10) and thereby prevent the hand of a person grasping the first handgrip from being hit by the striking tool.

9. A tool according to claim 8, wherein the second handgrip (11) is coaxial with the shaft (2).

10. A tool according to claim 1, wherein the first handgrip (10) is located at a distance from and parallel to the shaft (2).

11. A tool according to claim 10, wherein a guiding surface (20) is provided between the striking surface (7) on the head (5) and the front end (18) of the first handgrip (10), the guiding surface (20) being inclined from the front end (18) of the first handgrip (10) towards the striking surface (7) so as to guide a hitting striking tool away from the first handgrip (10) and thereby prevent the hand of a person grasping the first handgrip from being hit by the striking tool.

12. A tool according to claim 1, wherein the second handgrip (11) is coaxial with the shaft (2).

13. A tool according to claim 1, wherein the first and/or second handgrip (10, 11) is provided with a shock absorbing material layer (22).

14. A tool according to claim 1, wherein the tip (9) of the wedge part (8) is designed as a sharp edge (45; 55) extending in the cross-direction of the shaft (2).

15. A tool according to claim 1, wherein the wedge part (8) comprises a top surface (40), a bottom surface (41) and two side walls (42, 43) extending between the top surface (40) and the bottom surface (41) on opposite sides of the wedge part, each one of said side walls (42, 43) being provided with cutting edges (44) extending in parallel to each other or at least essentially in parallel to each other between the bottom surface (41) and the top surface (40).

16. A tool according to claim 1, wherein the rear portion (23) of the shaft (2) is bent inwards so as to form a rear support for the shaft on the same side of the shaft as the support member (30).

17. A tool for forcing a door, wherein the tool (1) comprises:

an elongated shaft (2) having a front end (3) and a rear end (4);

a handgrip (10) located between the front end (3) and the rear end (4) of the shaft (2); and a head (5) fixed to the shaft (2) at the front end (3) thereof, the head (5) having a base part (6) provided with a striking surface (7) on a first side for receiving impacts from a striking tool and a wedge part (8) extending from the base part (6) on the opposite side thereof essentially perpendicularly to the longitudinal axis of the shaft (2), said handgrip (10) is located at a distance from and parallel to the shaft (2);

a guiding surface (20) is provided between the striking surface (7) on the head (5) and the front end (18) of said handgrip (10), the guiding surface (20) being inclined from the front end (18) of the handgrip (10) towards the striking surface (7) so as to direct a hitting striking tool away from the handgrip (10) and thereby prevent the hand of a person grasping the handgrip from being hit by the striking tool; and the wedge part (8) comprises a top surface (40), a bottom surface (41) and two side walls (42, 43) extending between the top surface (40) and the bottom surface (41) on opposite sides of the wedge part, each one of said side walls (42, 43) being provided with cutting edges (44) extending in parallel to each other or at least essentially in parallel to each other between the bottom surface (41) and the top surface (40).

18. A tool according to claim 17, wherein the tip (9) of the wedge part (8) is designed as a sharp edge (45; 55) extending in the cross-direction of the shaft (2).

* * * * *